US010731107B2

(12) United States Patent
Vinson et al.

(10) Patent No.: US 10,731,107 B2
(45) Date of Patent: Aug. 4, 2020

(54) DETERGENT COMPOSITIONS COMPRISING AES SURFACTANT HAVING ALKYL CHAIN LENGTHS OF FOURTEEN TOTAL CARBONS

(71) Applicant: The Procter & Gamble Company, Cincinnati, OH (US)

(72) Inventors: Phillip Kyle Vinson, Fairfield, OH (US); Patrick Christopher Stenger, Fairfield, OH (US); William Coffin Shearouse, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/638,411

(22) Filed: Jun. 30, 2017

(65) Prior Publication Data

US 2019/0002796 A1 Jan. 3, 2019

(51) Int. Cl.

| | |
|---|---|
| ***C11D 1/83*** | (2006.01) |
| ***C11D 11/00*** | (2006.01) |
| ***C11D 1/37*** | (2006.01) |
| ***C11D 3/50*** | (2006.01) |
| ***C11D 1/24*** | (2006.01) |
| ***C11D 1/29*** | (2006.01) |
| ***C11D 1/66*** | (2006.01) |
| ***C11D 1/72*** | (2006.01) |
| ***C11D 1/75*** | (2006.01) |

(52) U.S. Cl.

CPC ..... *C11D 1/83* (2013.01); *C11D 1/37* (2013.01); *C11D 3/505* (2013.01); *C11D 11/0017* (2013.01); *C11D 1/24* (2013.01); *C11D 1/29* (2013.01); *C11D 1/662* (2013.01); *C11D 1/72* (2013.01); *C11D 1/75* (2013.01)

(58) Field of Classification Search

CPC .... C11D 1/08; C11D 1/37; C11D 1/29; C11D 1/75; C11D 1/24; C11D 1/72; C11D 1/662; C11D 3/505

See application file for complete search history.

(56) References Cited

U.S. PATENT DOCUMENTS

| | | | | |
|---|---|---|---|---|
| 3,775,349 | A | 11/1973 | Tuvell et al. | |
| 3,786,003 | A | 1/1974 | Hunter | |
| 6,251,844 | B1 | 6/2001 | Leonard et al. | |
| 6,294,513 | B1 | 9/2001 | Jensen et al. | |
| 6,410,498 | B1 | 6/2002 | Smets et al. | |
| 6,730,650 | B1 | 5/2004 | Wood | |
| 7,754,669 | B2 | 7/2010 | Bastigkeit et al. | |
| 7,994,369 | B2 | 8/2011 | Scheibel et al. | |
| 8,153,574 | B2 * | 4/2012 | Boutique | C11D 3/2072 510/300 |
| 8,232,431 | B2 | 7/2012 | Price et al. | |
| 8,232,432 | B2 | 7/2012 | Scheibel et al. | |
| 9,493,725 | B2 | 11/2016 | Vinson et al. | |
| 9,493,726 | B2 | 11/2016 | Vinson et al. | |
| 9,796,948 | B2 | 10/2017 | Shearouse et al. | |
| 10,087,403 | B2 | 10/2018 | Delaney et al. | |
| 2003/0134772 | A1 | 7/2003 | Dykstra et al. | |
| 2003/0199420 | A1 * | 10/2003 | Tsumori | C11D 1/143 510/475 |
| 2004/0018955 | A1 | 1/2004 | Wevers et al. | |
| 2006/0183660 | A1 | 8/2006 | Dovey et al. | |
| 2011/0112005 | A1 | 5/2011 | Brooker et al. | |
| 2012/0258900 | A1 | 10/2012 | Adams et al. | |
| 2014/0094397 | A1 * | 4/2014 | Guida | C11D 17/0013 510/342 |
| 2014/0349913 | A1 * | 11/2014 | Delaney | C11D 1/002 510/488 |
| 2015/0030644 | A1 | 1/2015 | Oh et al. | |
| 2015/0322387 | A1 | 11/2015 | Ohtani | |
| 2016/0068784 | A1 | 3/2016 | Vinson et al. | |
| 2016/0312152 | A1 | 10/2016 | Borne et al. | |
| 2016/0340611 | A1 * | 11/2016 | Scheibel | C11D 1/722 |
| 2017/0137748 | A1 | 5/2017 | Tang et al. | |
| 2017/0369816 | A1 | 12/2017 | Holland et al. | |
| 2018/0195029 | A1 | 7/2018 | Delaney | |
| 2019/0024026 | A1 | 1/2019 | Delaney | |

FOREIGN PATENT DOCUMENTS

| | | |
|---|---|---|
| WO | WO0071667 A1 | 11/2000 |

OTHER PUBLICATIONS

U.S. Appl. No. 15/403,277, filed Jan. 11, 2017, Sarah Ann Delaney.
International Search Report; International Application No. PCT/US2018/040163; dated Oct. 15, 2018; 13 pages.
14630 Search Report for PCT application No. PCT/US2018/013290, dated Apr. 24, 2018, 12 pages.

* cited by examiner

*Primary Examiner* — Amina S Khan
(74) *Attorney, Agent, or Firm* — Melissa G. Krasovec

(57) ABSTRACT

Compositions, such as detergent compositions, that include AES surfactant, where at least a particular portion of the AES surfactant molecules include alkyl portions having fourteen total carbons are described. Uses and methods related to such compositions are also described.

11 Claims, No Drawings

DETERGENT COMPOSITIONS COMPRISING AES SURFACTANT HAVING ALKYL CHAIN LENGTHS OF FOURTEEN TOTAL CARBONS

FIELD OF THE INVENTION

The present disclosure relates to detergent compositions that include AES surfactant, where at least a portion of the AES surfactant molecules include alkyl portions having fourteen carbons. The present disclosure also relates to uses and methods related to such compositions.

BACKGROUND OF THE INVENTION

Detergent manufacturers are continuously seeking ways to improve the soil removal benefits of their detergents. In particular, removal of greasy soils, such as those from bacon grease or butter, is desired because of the prevalence of such stains. However, such stains are generally hydrophobic and can be particularly challenging to remove in the aqueous environment of common automatic washing machines.

Although detergent adjuncts such as enzymes or polymers may be added to detergent compositions to fight target stains, such adjuncts can bring added cost and/or compatibility issues.

Furthermore, surfactants remain the detergent formulator's workhorse ingredient. While it is possible to develop new-to-the-world surfactants, it may be desirable to work with known ingredients in a new way for cost, supply chain, and/or compatibility reasons.

Additionally, many traditional surfactants are petroleum-derived, but today's consumer tends to be more environmentally conscious and may seek products that are non-petroleum derived and/or naturally sourced. However, the consumer still demands quality performance from such products.

There is a need for detergent compositions that provide improved performance, particularly the compositions include known and/or naturally sourced materials.

SUMMARY OF THE INVENTION

The present disclosure relates to detergent compositions that include: from about 5% to about 50%, by weight of the composition, of a surfactant system, the surfactant system including an alkyl ethoxylated sulfate (AES) surfactant and at least a second surfactant, where at least 50%, by mass, of the AES molecules contain an alkyl portion having 14 carbons; and a laundry adjunct.

The present disclosure also relates to a single-surfactant detergent composition that includes from about 5% to about 50%, by weight of the composition, of a surfactant system that consists essentially of AES surfactant, where from about 46% to about 82%, by mass, of the AES surfactant molecules contain an alkyl portion having 14 carbons; and a laundry adjunct.

The present disclosure also relates to a concentrated surfactant composition that includes: from about 50% to about 99%, by weight of the composition, of alkyl ethoxylated sulfate (AES) surfactant, where at least 50%, by mass, of the AES molecules contain an alkyl portion having 14 carbons; and water.

The present disclosure also relates to surfactant compositions that consist essentially of: at least about 23%, by weight of the composition, of alkyl ethoxylated sulfate (AES) surfactant, wherein at least 50%, by mass, of the AES molecules contain an alkyl portion having 14 carbons; from about 1% to about 25%, by weight of the composition, of organic solvent; and water.

The present disclosure also relates to methods of treating a fabric, the methods including the steps of: providing a fabric, preferably where the fabric includes a greasy soil; contacting the fabric with a composition according to the present disclosure; and agitating the fabric in the presence of water.

The present disclosure also relates to a use of C14 AES in cleaning compositions to remove soils, preferably greasy soils, for example the use of an alkyl ethoxylated sulfate (AES) surfactant in a detergent composition to remove soils, preferably greasy soils, where at least 50%, or at least 60%, or at least 75%, by mass, of the AES molecules contain an alkyl portion having 14 total carbons.

DETAILED DESCRIPTION OF THE INVENTION

Detergent manufacturers commonly use alkyl ethoxylated sulfate (AES) in detergent formulations. AES molecules include an alkyl portion, and most AES surfactants comprise AES molecules that include alkyl portions in a variety of carbon chain lengths. The AES alkyl chain lengths often range from 10 carbon atoms to 18 carbon atoms in a distribution.

The present disclosure relates to detergent compositions that include alkyl ethoxylated sulfate (AES) surfactant that include alkyl portions having 14 carbon atoms (aka, C14 AES). While C14 AES per se is a known material, it has surprisingly been found that detergent compositions having particular proportions of C14 AES, including in combination with other surfactants, are likely to provide superior cleaning benefits, including greasy soil removal.

Without wishing to be bound by theory, it is believed that the longer carbon chain lengths lower the interfacial tension at the oil-water interface to a greater degree compared to shorter carbon chain lengths, leading to improved cleaning of soils, for example greasy soils, both as a single surfactant and in combination with other surfactants in a surfactant system.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, postrinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Detergent Compositions

The present disclosure relates to detergent compositions. The detergent compositions may comprise surfactant systems, which are discussed in more detail below.

The detergent composition may have any desired form, including, for example, a form selected from liquid, powder, single-phase or multi-phase unit dose, pouch, tablet, gel, paste, bar, or flake.

The detergent composition may be selected from the group of light duty liquid detergents compositions, heavy duty liquid detergent compositions, hard surface cleaning compositions (such as hand or automatic dishwashing compositions), detergent gels commonly used for laundry, laundry additives, fabric enhancer compositions, and mixtures thereof. The detergent composition may be selected from a hard surface cleaning composition (such as a dishwashing composition), a fabric care composition (such as a heavy duty liquid detergent composition), or a mixture thereof.

The detergent composition may be a liquid laundry detergent. The liquid laundry detergent composition may have a viscosity from about 1 to about 2000 centipoise (1-2000 mPa·s), or from about 200 to about 800 centipoise (200-800 mPa·s). The viscosity is determined using a Brookfield viscometer, No. 2 spindle, at 60 RPM/s, measured at 25° C.

The detergent composition may be a solid laundry detergent composition, and may be a free-flowing particulate laundry detergent composition (i.e., a granular detergent product).

The detergent composition may be in unit dose form. A unit dose article is intended to provide a single, easy to use dose of the composition contained within the article for a particular application. The unit dose form may be a pouch or a water-soluble sheet. A pouch may comprise at least one, or at least two, or at least three compartments. Typically, the composition is contained in at least one of the compartments. The compartments may be arranged in superposed orientation, i.e., one positioned on top of the other, where they may share a common wall. At least one compartment may be superposed on another compartment. Alternatively, the compartments may be positioned in a side-by-side orientation, i.e., one orientated next to the other. The compartments may even be orientated in a 'tire and rim' arrangement, i.e., a first compartment is positioned next to a second compartment, but the first compartment at least partially surrounds the second compartment, but does not completely enclose the second compartment. Alternatively, one compartment may be completely enclosed within another compartment.

The unit dose form may comprise water-soluble film that forms the compartment and encapsulates the detergent composition, such as a hard surface cleaning composition (such as a dishwashing composition) or a fabric care composition. Preferred film materials are polymeric materials; for example, the water-soluble film may comprise polyvinyl alcohol. The film material can, for example, be obtained by casting, blow-moulding, extrusion, or blown extrusion of the polymeric material, as known in the art. Suitable films are those supplied by Monosol (Merrillville, Ind., USA) under the trade references M8630, M8900, M8779, and M8310, and PVOH films of corresponding solubility and deformability characteristics.

When the detergent composition is a liquid, the surfactant composition typically comprises water. The composition may comprise from about 1% to about 80%, by weight of the composition, water. When the composition is a heavy duty liquid detergent composition, the composition typically comprises from about 40% to about 80% water. When the composition is a compact liquid detergent, the composition typically comprises from about 20% to about 60%, or from about 30% to about 50% water. When the composition is in unit dose form, for example, encapsulated in water-soluble film, the composition typically comprises less than 20%, or less than 15%, or less than 12%, or less than 10%, or less than 8%, or less than 5% water. The composition may comprise from about 1% to 20%, or from about 3% to about 15%, or from about 5% to about 12%, by weight of the composition, water.

The detergent compositions of the present disclosure may be substantially transparent. Substantially transparent detergents may be aesthetically pleasing and/or may signal "purity" or "natural-ness" to a consumer, as such detergents are substantially free of dyes, opacifiers, and/or other aesthetic additives that do not provide a performance benefit. Such detergents, free of such aesthetic additives, may also be attractive to consumers who are interested in sustainable or environmentally friendly products. The detergent compositions of the present disclosure may be substantially free of dyes, particularly aesthetic dyes, and/or opacifiers. The detergent compositions of the present disclosure may be characterized by a percent transmittance of greater than about 50%, or greater than about 60%, or greater than about 80%, or greater than about 90%, at a wavelength of 570 nm measured at room temperature via a standard 10 mm path-length cuvette with a Beckman DU spectrophotometer using deionized water as blank, in the absence of dyes and/or opacifiers. Percent transmittance is determined according to the method provided in the Test Methods section.

The detergent composition may comprise a surfactant system comprising at least two surfactants. The detergent composition may be a single-surfactant detergent composition. In addition to the surfactant, such detergent compositions may comprise an adjunct material, such as a laundry and/or a dishwashing adjunct. These components are discussed in more detail below.

Surfactant System

The detergent compositions of the present disclosure comprise a surfactant system. The surfactant system may comprise one or more, or two or more, detersive surfactants suitable for the intended end-use of the detergent composition.

The detergent composition may comprise from about 1% to about 80%, or from about 5% to about 50%, or from about 7% to about 45%, by weight of the detergent composition, of the surfactant system. The detergent composition may comprise from about 5% to about 25%, by weight of the detergent composition, of the surfactant system.

The surfactant system may comprise an alkyl ethoxylated sulfate (AES) surfactant and at least a second surfactant; in such surfactant systems, at least 50%, by mass, of the AES molecules may contain an alkyl portion having 14 carbons. The surfactant system may consist essentially of AES surfactant; in such surfactant systems (i.e., a single-surfactant system), from about 46%, or from about 50%, or from about 55%, or from about 58%, to about 82%, or to about 70%, by mass, of the AES surfactant molecules may contain an alkyl portion having 14 carbons. AES and other surfactants are described in more detail below.

Alkyl Ethoxylated Sulfate Surfactant (AES)

The detergent compositions and/or surfactant systems of the present disclosure include alkyl ethoxylated sulfate (AES) surfactant. It has been found that detergent compositions comprising AES, where a certain proportion of the AES compounds have a total of fourteen carbon atoms in the alkyl chain, provide surprising benefits.

AES compounds have an alkyl portion. The alkyl portion of a particular AES compound may be characterized by the total number of carbons in the alkyl portion, otherwise known as the alkyl chain lengths. A given amount of AES surfactant may include a variety of AES compounds having chain lengths that fall within certain proportions or distributions. Thus, a given amount or sample of AES may be characterized by a weight average number of carbons in the alkyl portion.

Commercially available AES surfactants include AES having weight average chain lengths of from twelve to fifteen, known as C12-15 AES, or chain lengths of from twelve to fourteen, known as C12-14 AES. These AES surfactants may include at least some AES compounds having chain lengths of fourteen carbons, but are typically characterized by a relatively wide and varied distribution of other chain lengths as well.

In contrast, the AES of the present disclosure include a relatively high proportion of AES compounds having a total of fourteen carbons in the alkyl portion. For the purposes of this disclosure, such AES will be called C14 AES. For example, the detergent compositions and/or surfactant systems of the present disclosure may include AES where at least 50%, by mass, of the AES molecules contain an alkyl portion having 14 carbons. At least 60%, or at least 70%, or at least 80%, or at least 90%, or at least 95%, by mass, of the AES molecules may contain an alkyl portion having 14 carbons. As used herein, percentages of AES molecules having an alkyl portion of a certain number of carbons (e.g., fourteen) are provided as percentages by mass of the total amount of AES present, unless stated otherwise.

The alkyl portion of an AES compound may have an even or odd total number of carbon atoms. At least 60%, or 70%, or 80%, or 90%, or 95%, or 100%, by mass, of the AES molecules may have alkyl portions having an even total number of carbon atoms.

AES compounds are typically manufactured by sulfating an ethoxylated fatty alcohol. A fatty alcohol may first be provided, then ethoxylated according to known methods. Thus, AES compounds, or at least the alkyl portions of the AES compounds, may be described in terms of the sources, for example oils or fatty alcohols, from which they are derived. The AES compounds of the present disclosure may include alkyl portions that are derived from a non-petroleum source, preferably from a natural source. The AES of the present disclosure may include mixtures of AES that includes alkyl portions that are naturally derived and AES that includes alkyl portions of AES that are synthetically derived (e.g., petrol-derived); such mixtures may be useful to account for supply chain variations, disruptions, and/or pricing fluctuations, e.g. so that a shortage of one type of AES may be back-filled by another type.

Natural sources may include oils derived from plants or animal sources, preferably from plants. Representative non-limiting examples of vegetable oils include canola oil, rapeseed oil, coconut oil, corn oil, cottonseed oil, olive oil, palm oil, peanut oil, safflower oil, sesame oil, soybean oil, sunflower oil, linseed oil, palm kernel oil, tung oil, jatropha oil, mustard oil, pennycress oil, camelina oil, castor oil, or mixtures thereof. Suitable feedstock oils may include metathesized oils, typically formed from a metathesis reaction in the presence of a suitable metathesis catalyst. The alkyl portion may be derived from coconut oil, palm kernel oil, or mixtures thereof, preferably from coconut oil, palm kernel oil, or mixtures thereof. Such sources may be desirable for environmental and/or sustainability reasons, as they do not rely on fossil fuels. Further, the alkyl portion of AES compounds derived from natural sources typically contain an even number of carbon atoms.

It may be that the AES of the present disclosure is not derived from a Fischer-Tropsch process. It may be that the AES of the present disclosure is not derived from the well-known Shell modified oxo process. The AES of the present disclosure may include AES that is derived from the Ziegler process.

The AES compounds of the present disclosure may contain alkyl portions that are linear, branched, or mixtures thereof (i.e., some AES molecules have linear alkyl portions, while others have branched alkyl portions). Linear alkyl portions of the AES compounds may be preferred. At least about 50%, or at least about 75%, or at least about 90%, or at least about 95%, or about 100%, by weight of the AES surfactant, of the AES molecules have alkyl portions that are linear alkyl portions.

AES compounds may also be characterized by their degrees of ethoxylation. In a population of AES compounds, the AES molecules may have varying degrees of ethoxylation. Thus, a given amount or sample of AES may be characterized by a weight average degree of ethoxylation. The AES of the present disclosure may be characterized by a weight average degree of ethoxylation of from about 0.5 to about 8.0, or from about 0.8 to about 3.0, or from about 1.0 to about 2.5, or from about 1.0 to about 2.0. When the amount of linear alkyl benzene sulfonate surfactant in the surfactant system is low or non-existent, it may be preferred for the surfactant systems to include AES having a relatively low degree of ethoxylation, as such AES may provide grease cleaning benefits.

The detergent composition and/or surfactant system may include AES compounds of the formula $R^1$—$(OCH_2CH_2)_x$—O—$SO_3M$. $R^1$ may be a non-petroleum derived alkyl chain. $R^1$ may be a linear or branched alkyl chain. $R^1$ may consist of even-numbered carbon chain lengths. R1 may be a carbon chain of from about eight to about 20. At least about 60%, or at least about 70%, or at least about 80%, or at least about 90%, or at least about 95%, or at least about 98%, or about 100%, by weight of the AES, of the AES may comprise an R1 that is an alkyl chain consisting of fourteen carbons, preferably a non-petroleum derived alkyl chain, where the alkyl chain is linear or branched. The value of x may be from about 0.5 to about 8, or from about 0.8 to about 3.0, or from about 1.0 to about 2.5, or from about 1.0 to about 2.0. M may be an alkali metal cation, preferably a sodium cation, or an ammonium cation. The alkyl chain may be derived from a natural source, such as the plant sources described above.

The AES may be present in the surfactant system at a level of about 10% to about 100%, or from about 10% to about 99%, or from about 25% to about 100%, or from about 25% to about 99%, or from about 50% to about 80%, by weight of the surfactant system. The AES may be present in the detergent composition at a level of about 1% to about 50%, or from about 5% to about 40%, or from about 10% to about 30%, or from about 15% to about 25%, by weight of the detergent composition.

Second Surfactant

The detergent compositions and/or surfactant systems of the present disclosure may include at least a second surfactant in addition to the AES. The second surfactant may be derived from a non-petroleum source, preferably from a natural source.

The second surfactant may be present in the surfactant system at a level of about 0.1% to about 90%, or from about 0.1% to about 75%, or from about 20% to about 50%, by weight of the surfactant system. The second surfactant may be present in the detergent composition at a level of about about 1% to about 50%, or from about 5% to about 40%, or from about 10% to about 30%, or from about 15% to about 25%, by weight of the detergent composition.

The second surfactant may be any suitable detersive surfactant. The second surfactant may be selected from an anionic surfactant, a nonionic surfactant, a zwitterionic surfactant, an amphoteric surfactant, a cationic surfactant, or mixtures thereof, preferably an anionic, nonionic, or zwitterionic surfactant. The second surfactant may be selected from alkyl benzene sulphonate, ethoxylated alcohol nonionic surfactant, amine oxide, methyl ester sulphonate, glycolipid surfactant, alkylpolyglucoside surfactant, or combinations thereof. The second surfactant may be ethoxylated alcohol nonionic surfactant, amine oxide, or combinations thereof. The second surfactant may be amine oxide.

As mentioned above, the second surfactant may be an amine oxide surfactant. Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) O wherein R1 is a C8-18 alkyl and R2 and R3 are selected from the group consisting of methyl, ethyl, propyl, isopropyl, 2-hydroxyethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that |n1-n2| is less than or equal to 5, preferably 4, most preferably from 0 to 4 carbon atoms in at least 50 wt %, more preferably at least 75 wt % to 100 wt % of the mid-branched amine oxides for use herein.

The amine oxide may further comprise two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

The compositions of the present disclosure may include from about 0.1% to about 5%, or to about 3%, or to about 1%, by weight of the composition, of amine oxide. The AES of the present disclosure and the amine oxide may be present in a weight ratio of from about 3:1 to about 10:1, or from about 3:1 to about 7:1, or from about 3:1 to about 5:1. Without wishing to be bound by theory, it is believed that the AES and the amine oxide work synergistically to provide superior cleaning and/or other treatment benefits.

The second surfactant may be a nonionic surfactant. The nonionic surfactant may be an ethoxylated alcohol surfactant and/or ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15.

The nonionic surfactant may be an ethoxylated alcohol. For example, the nonionic surfactant may be selected from ethoxylated alcohols having an average of about 12-14 carbon atoms in the alcohol (alkyl) portion and an average degree of ethoxylation of about 7-9 moles of ethylene oxide per mole of alcohol.

Other non-limiting examples of nonionic surfactants may include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, as discussed in U.S. Pat. No. 6,150,322; $C_{14}$-$C_{22}$ mid-chain branched alkyl alkoxylates, $BAE_x$, wherein x is from 1 to 30; alkylpolysaccharides, specifically alkylpolyglycosides; polyhydroxy fatty acid amides; and ether capped poly(oxyalkylated) alcohol surfactants.

The second surfactant may comprise alkyl benzene sulfonate surfactant. The alkyl group may contain from about 9 to about 15 carbon atoms, in straight chain (linear) or branched chain configuration. The alkyl group may be linear. Such linear alkylbenzene sulfonates are known as "LAS." The linear alkylbenzene sulfonate may have an average number of carbon atoms in the alkyl group of from about 11 to 14. The linear straight chain alkyl benzene sulfonates may have an average number of carbon atoms in the alkyl group of about 11.8 carbon atoms, which may be abbreviated as C11.8 LAS. The alkyl benzene sulfonate may be present, at least partly, as a salt, such as an alkali metal salt, preferably a sodium salt, or an amine salt, such as an ethanolamine salt, e.g., an monoethanolamine salt.

Suitable alkyl benzene sulphonate (LAS) may be obtained by sulphonating commercially available linear alkyl benzene (LAB). Suitable LAB includes low 2-phenyl LAB, such as those supplied by Sasol under the tradename Isochem® or those supplied by Petresa under the tradename Petrelab®. Other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as those catalyzed by hydrofluoric acid (HF), may also be suitable.

The surfactant system may comprise less than 25%, or less than 10%, or less than 5%, or less than 1% of linear alkyl benzene sulfonate (LAS). As LAS typically provides cleaning benefits for hydrophobic stains, such as greasy stains, it may be preferred that in such cases of low levels of LAS (if any at all), the AES is characterized by an average degree of ethoxylation of from about 0.5 to about 3.0, or from about 0.5 to about 2.0, or from about 0.5 to about 1.5, as it is believed that lower degrees of AES ethoxylation may help to provide hydrophobic stain removal benefits.

The surfactant system may include surfactant may be a cationic surfactant. Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium surfactants; dimethyl hydroxyethyl lauryl ammonium chloride; polyamine cationic surfactants; cationic ester surfactants; and amino surfactants, such as amido propyldimethyl amine (APA). The compositions of the present disclosure may be substantially free of cationic surfactants and/or of surfactants that become cationic below a pH of 7 or below a pH of 6, as cationic surfactants may negatively interact with other components, such as anionic surfactants.

The surfactant system may include a zwitterionic surfactant. Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. The zwitterionic surfactants may comprise betaines, including alkyl dimethyl betaine, cocodimethyl amidopropyl betaine, and $C_8$ to $C_{18}$ (for example from $C_{12}$ to $C_{18}$) amine oxide and sulfo and hydroxy betaines, such as N-alkyl-N,N-dimethylammino-1-propane sulfonate where the alkyl group can be from $C_8$ to $C_{18}$ or from $C_{10}$ to $C_{14}$.

The surfactant system may include non-ethoxylated alkyl sulfates. Examples of non-alkoxylated, e.g., non-ethoxylated, alkyl sulfate surfactants include those produced by the sulfation of higher $C_8$-$C_{20}$ fatty alcohols. Primary alkyl sulfate surfactants may have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium. Ethoxylated or non-ethoxylated sulfate surfactants can be formed by the sulfation of alcohols that include alkyl chains.

The surfactant system may include a branched surfactant. Suitable branched surfactant may comprise a non-sulfonated C12/13 alcohol-based surfactant comprising a methyl branch randomly distributed along the hydrophobe chain, e.g., Safol®, Marlipal® available from Sasol. Further suitable additional branched anionic detersive surfactants include non-sulfonated surfactants derived from alcohols branched in the 2-alkyl position, such as those sold under the trade names Isalchem®123, Isalchem®125, Isalchem®145, Isalchem®167, which are derived from the oxo process. Due to the oxo process, the branching is situated in the 2-alkyl position. These 2-alkyl branched alcohols are typically in the range of C11 to C14/C15 in length and comprise structural isomers that are all branched in the 2-alkyl position. Additional suitable non-sulfonated branched anionic detersive surfactants may include surfactant derivatives of isoprenoid-based polybranched detergent alcohols; branched surfactants derived from anteiso and iso-alcohols; and/or Guerbet-alcohol-based surfactants. The surfactant system may include other branched surfactants, such as modified alkylbenzene sulfonate (MLAS).

Other anionic surfactants useful herein are the water-soluble salts of: $C_8$-$C_{24}$ paraffin sulfonates; $C_8$-$C_{24}$ secondary alkane sulfonates; $C_8$-$C_{18}$ alkyl glyceryl ether sulfonates; $C_8$-$C_{18}$ branched alkyl sulfonates; $C_{12}$-$C_{20}$ methyl ester sulfonates; $C_{12}$-$C_{24}$ olefin sulfontes; $C_{10}$-$C_{18}$ alkyl ether carboxylates; $C_{10}$-$C_{18}$ alkyl ether carboxylates comprising an average degree of alkoxylation of from 1 to 5; $C_6$-$C_{20}$ sulfosuccinate surfactant; esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; β-alkyloxy alkane sulfonates containing from about 1 to 3 carbon atoms in the alkyl group and from about 8 to 20 carbon atoms in the alkane moiety. Additional suitable branched anionic detersive surfactants include surfactant derivatives of isoprenoid-based polybranched detergent alcohols. Mixtures of the alkylbenzene sulfonates with the above-described paraffin sulfonates, secondary alkane sulfonates and alkyl glyceryl ether sulfonates may also useful.

Other useful surfactants may include glycolipid surfactants, such as rhamnolipids and/or sophorolipids. Such surfactants may be particularly useful because they may be naturally derived (e.g., from microorganisms).

Detergent Adjunct

The surfactant composition may further comprise at least one detergent adjunct. The detergent adjunct(s) may be present in the composition at levels suitable for the intended use of the composition. Typical usage levels range from as low as 0.001% by weight of composition for adjuncts such as optical brighteners to 50% by weight of composition for builders.

The at least one detergent adjunct may be selected from the group consisting of fatty acids and/or salts thereof, enzymes, encapsulated benefit agents, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, polymeric dispersing agents, polymeric grease cleaning agents, brighteners, suds suppressors, dyes, hueing agents, perfume, structure elasticizing agents, fabric softeners, carriers, fillers, hydrotropes, solvents, anti-microbial agents and/or preservatives, neutralizers and/or pH adjusting agents, processing aids, fillers, rheology modifiers or structurants, opacifiers, pearlescent agents, pigments, anti-corrosion and/or anti-tarnishing agents, and mixtures thereof. The at least one detergent adjunct may be at least one laundry adjunct selected from the group consisting of a structurant, a builder, a fabric softening agent, a polymer or an oligomer, an enzyme, an enzyme stabilizer, a bleach system, a brightener, a hueing agent, a chelating agent, a suds suppressor, a conditioning agent, a humectant, a perfume, a encapsulated perfume, a filler or carrier, an alkalinity system, a pH control system, a buffer, an alkanolamine, a solvent, and mixtures thereof.

The at least one detergent adjunct may include external structuring systems, enzymes, encapsulated benefit agents, soil release polymers, hueing agents, and mixtures thereof. The encapsulated benefit agent may be encapsulated perfume, preferably where the encapsulated perfume comprises a shell surrounding a core, preferably where the shell is free of amine compounds, preferably where the shell comprises acrylate polymers.

The compositions of the present disclosure may include solvent, preferably organic solvent, such as a non-amino-functional organic solvent. Suitable organic solvents may include glycerol, ethylene glycol, 1,3 propanediol, 1,2 propanediol, tetramethylene glycol, pentamethylene glycol, hexamethylene glycol, 2,3-butane diol, 1,3 butanediol, diethylene glycol, triethylene glycol, polyethylene glycol, glycerol formal dipropylene glycol, polypropylene glycol, dipropylene glycol n-butyl ether, and mixtures thereof.

It may be desirable to limit or even eliminate certain adjuncts, particularly if a detergent sourced primarily from natural or sustainable sources is desired. The detergent compositions of the present disclosure may be free of silicone, dye, brightener, or combinations thereof. The detergent compositions of the present disclosure may comprise less than 5%, or less than 3%, or less than 1%, by weight of the composition, of amine-containing compounds, with the proviso that amine oxide surfactant (if present) is not included in the total amount of amine-containing compounds.

Concentrated AES Surfactant Composition

The present disclosure further relates to concentrated AES surfactant compositions. Such concentrated compositions are useful for saving transportation costs and for incorporation into product compositions at desired levels without bringing in much undesired and/or inactive material, such as carriers.

The concentrated AES compositions of the present disclosure may comprise from about 50%, or from about 60%, or from about 75%, or from about 80%, or from about 85%, or from about 90%, or from about 95% to about 99%, or to about 98%, by weight of the composition, of AES surfactant, wherein at least 50% of the AES molecules contain an alkyl portion having 14 carbons. The concentrated AES compositions may also comprise water.

At least a portion of the concentrated AES surfactant may be neutralized, preferably with a caustic agent, such as sodium hydroxide. At least a portion of the concentrated AES surfactant may be present in salt form, preferably a sodium salt form.

The concentrated AES surfactant compositions of the present disclosure may comprise from about 1%, or from about 2%, to about 25%, or to about 20%, or to about 15%, or to about 10%, or to about 5%, or to about 2%, by weight of the composition, of an additional material. The additional material may be selected from water, unsulfated alcohol (alkoxylated and/or non-alkoxylated), an alkali metal sulfate salt (preferably sodium sulfate) and/or other electrolytes, unalkoxylated alkyl sulfate surfactant, organic solvent, and mixtures thereof. These materials may be processing aids, by-products, and/or unreacted reactants from the synthesis of the branched sulfonate surfactant. Additionally or alternatively, these materials may be the products of hydrolysis of the AES surfactant. The concentrated AES surfactant compositions may be substantially free of other detergent adjunct materials.

The concentrated AES surfactant compositions may be substantially free of other surfactants, such as other anionic, nonionic, amphoteric, cationic surfactants, and/or zwitterionic surfactants.

The concentrated AES surfactant compositions according to the present disclosure may comprise linear alkyl benzene sulfonate surfactant (LAS). The linear alkyl benzene sulfonate surfactant may present at a level of from about 0% to about 15%, or from about 2% to about 15%, or from about 5% to about 12%, by weight of the composition.

The concentrated AES surfactant compositions of the present disclosure may comprise an alkoxylated polyalkyleneimine polymer, such as an alkoxylated polyethyleneimine (PEI) polymer. The alkoxylated polyalkylenimine may be present in the composition at a level of from about 0.1% to about 5%, or from about 0.5% to about 4.5%, preferably from about 0.75% to about 1.5%, by weight of the composition. The alkoxylated polyalkyleneimine polymer, preferably alkoxylated PEI, may comprise ethoxylate (EO) groups, propoxylate (PO) groups, or combinations thereof. The alkoxylated polyalkyleneimine polymer, preferably alkoxylated PEI, may comprise ethoxylate (EO) groups. The alkoxylated polyalkyleneimine polymer, preferably alkoxylated PEI, may be free of propoxlyate (PO) groups. The alkoxylated polyalkyleneimine polymer, preferably alkoxylated PEI, may comprise on average per alkoxylated nitrogen, about 1-50 ethoxylate (EO) groups and about 0-5 propoxylate (PO) groups. The alkxoylated polyalkylenimine may be linear, branched, or combinations thereof, preferably branched. Suitable alkoxylated polyalkyleneimines, such as PEI600 EO20, are available from BASF (Ludwigshafen, Germany).

The present disclosure relates to surfactant compositions that may consist essentially of: at least about 23% AES surfactant, wherein at least 50% of the AES molecules contain an alkyl portion having 14 carbons; from about 1% to about 25%, or from about 2% to about 10%, or from about 3% to about 8%, by weight of the composition, of organic solvent; and water.

The concentrated AES surfactant compositions may have a limited number of ingredients, which can maximize formulation flexibility in a final product (or in a plurality of final products). The concentrated AES surfactant may have no more than about 5 ingredients, or no more than about 4 ingredients, or not more than about 3 ingredients, not including reaction by-products or unreacted reactants that may be present in the composition.

Method of Making Detergent Compositions

The present disclosure relates to methods of making detergent compositions comprising the surfactant systems described herein. The method may include combining the components of the compositions described herein in the proportions described.

For example, the process of making a detergent composition according to the present disclosure may include providing AES surfactant, where at least 50% by weight of the AES molecules have alkyl portions having fourteen carbon atoms, optionally providing a second surfactant, and combining the surfactant(s) with one or more detergent adjuncts to form the detergent composition.

Liquid compositions according to the present disclosure may be made according to conventional methods, for example in a batch process or in a continuous loop process.

Dry (e.g., powdered or granular) compositions may be made according to conventional methods, for example by spray-drying or blow-drying a slurry comprising the components described herein The detergent compositions described herein may be encapsulated in a pouch, preferably a pouch made of water-soluble film, to form a unit dose article that may be used to treat fabrics.

Method of Using Detergent Compositions

The present disclosure relates to methods of using the detergent compositions described herein. The detergent compositions may be used to treat a surface, such as a fabric or a hard surface.

Methods of treating a surface may include the steps of: providing a surface, preferably a fabric, and contacting the surface with a detergent composition as described above. The surface, preferably a fabric, may comprise a greasy soil. The method may include agitating the fabric in the presence of water. The method may further comprise the step of carrying out a washing or cleaning operation. Water may be added before, during, or after the contacting step to form a wash liquor.

The present disclosure also relates to a process for the washing, for example by machine, of fabric, preferably soiled fabric, using a composition according to the present disclosure, comprising the steps of, placing a detergent composition according to the present disclosure into contact with the fabric to be washed, and carrying out a washing or cleaning operation.

Any suitable washing machine may be used, for example, a top-loading or front-loading automatic washing machine. Those skilled in the art will recognize suitable machines for the relevant wash operation. The article of the present disclosure may be used in combination with other compositions, such as fabric additives, fabric softeners, rinse aids, and the like. Additionally, the detergent compositions of the present disclosure may be used in known hand washing methods.

The present disclosure may also be directed to a method of treating a fabric, the method comprising the steps of contacting a fabric with a detergent composition described herein, carrying out a washing step, and then contacting the fabric with a fabric softening composition. The entire method, or at least the washing step, may be carried out by hand, be machine-assisted, or occur in an automatic washing machine. The step of contacting the fabric with a fabric softening composition may occur in the presence of water, for example during a rinse cycle of an automatic washing machine.

Use of C14 AES

The present disclosure relates to the use of C14 AES in cleaning compositions to remove soils, preferably greasy soils. For example, the present disclosure relates to the use of an alkyl ethoxylated sulfate (AES) surfactant in a laundry detergent composition to remove soils, preferably greasy soils, wherein at least 50%, or at least 60%, or at least 75%, of the AES molecules contain an alkyl portion having 14 total carbons.

Combinations

Specifically contemplated combinations of the disclosure are herein described in the following lettered paragraphs. These combinations are intended to be illustrative in nature and are not intended to be limiting.

A. A detergent composition comprising: from about 5% to about 50%, by weight of the composition, of a surfactant system, the surfactant system comprising an alkyl ethoxylated sulfate (AES) surfactant and at least a second surfactant, wherein at least 50% of the AES molecules contain an alkyl portion having 14 carbons, and a laundry adjunct.

B. A detergent according to paragraph A, wherein at least 60%, or at least 70%, or at least 80%, or at least 90%, or at least 95% of the AES molecules contain an alkyl portion having 14 carbons.

C. A detergent composition according to any of paragraphs A-B, wherein the AES is characterized by an average degree of ethoxylation of from 0.5 to 8.0, or from 0.8 to 3.0, or from 1.0 to 2.5, or from 1.0 to 2.0.

D. A detergent composition according to any of paragraphs A-C, wherein at least 60%, or at least 70%, or at least 80%, or at least 90%, or at least 95%, or at least 100% of the AES molecules have alkyl portions having an even total number of carbon atoms.

E. A detergent composition according to any of paragraphs A-D, wherein the alkyl portion is derived from a non-petroleum source, preferably from a natural source.

F. A detergent composition according to any of paragraphs A-E, wherein the alkyl portion is derived from coconut oil, palm kernel oil, or mixtures thereof.

G. A detergent composition according to any of paragraphs A-F, wherein at least 50%, or at least 75%, or at least 90%, or at least 95%, or about 100%, by weight of the AES surfactant, of the AES molecules have alkyl portions that are linear alkyl portions.

H1. A detergent composition according to any of paragraphs A-G, wherein the AES surfactant is not derived from a Fischer-Tropsch process.

H2. A detergent composition according to any of paragraphs A-H1, wherein the AES surfactant is not derived from the Shell modified oxo process.

H3. A detergent composition according to any of paragraphs A-H2, wherein the AES surfactant comprises AES that is derived from the Ziegler process.

I. A detergent composition according to any of paragraphs A-H, wherein the AES is present in the surfactant system at a level of about 10% to about 100%, by weight of the surfactant system.

J. A detergent composition according to any of paragraphs A-I, wherein the AES is present in the detergent composition at a level of about 1% to about 50%, by weight of the detergent composition.

K. A detergent composition according to any of paragraphs A-J, wherein the second surfactant is selected from alkyl benzene sulphonate, ethoxylated alcohol nonionic surfactant, amine oxide, methyl ester sulphonate, glycolipid surfactant, alkylpolyglucoside surfactant, or combinations thereof, preferably from linear alkyl benzene sulphonate, ethoxylated alcohol nonionic surfactant, amine oxide, or combinations thereof, more preferably ethyoxlated alcohol nonionic surfactant, amine oxide, or combinations thereof.

L. A detergent composition according to any of paragraphs A-K, wherein the second surfactant is amine oxide, for example wherein the AES and the amine oxide are present in a weight ratio of from about 3:1 to about 10:1, or from about 3:1 to about 7:1, or from about 3:1 to about 5:1.

M. A detergent composition according to any of paragraphs A-L, wherein the surfactant system comprises less than 25%, or less than 10%, or less than 5%, or less than 1% of linear alkyl benzene sulfonate, preferably wherein the AES is characterized by an average degree of ethoxylation of from about 0.5 to about 2.0, or from about 0.5 to about 1.5.

N. A detergent composition according to any of paragraphs A-M, wherein the second surfactant is derived from a non-petroleum source, preferably from a natural source.

O. A detergent composition according to any of paragraphs A-N, wherein the detergent composition is free of silicone, dye, brightener, or combinations thereof.

P. A detergent composition according to any of paragraphs A-O, wherein the detergent composition comprises less than 5%, or less than 3%, or less than 1%, by weight of the composition, of amine-containing compounds, with the proviso that amine oxide surfactant (if present) is not included in the total amount of amine-containing compounds.

Q. A detergent composition according to any of paragraphs A-P, wherein the composition has a percent transmittance at 570 nm of greater than about 50%.

R. A detergent composition according to any of paragraphs A-Q, wherein the laundry adjunct is selected from the group consisting of a structurant, a builder, a fabric softening agent, a polymer or an oligomer, an enzyme, an enzyme stabilizer, a bleach system, a brightener, a hueing agent, a chelating agent, a suds suppressor, a conditioning agent, a humectant, a perfume, a encapsulated perfume, a filler or carrier, an alkalinity system, a pH control system, a buffer, an alkanolamine, a solvent, and mixtures thereof.

S. A detergent composition according to any of paragraphs A-R, wherein the laundry adjunct comprises an encapsulated perfume, preferably where the encapsulated perfume comprises a shell surrounding a core, preferably where the shell is free of amine compounds, preferably where the shell comprises acrylate polymers.

T. A method of treating a fabric, the method comprising the steps of: providing a fabric, preferably wherein the fabric comprises a greasy soil, contacting the fabric with a detergent composition according to any of paragraphs A-T, and agitating the fabric in the presence of water.

U. A concentrated surfactant composition comprising: from about 50% to about 99%, by weight of the composition, of alkyl ethoxylated sulfate (AES) surfactant, wherein at least 50% of the AES molecules contain an alkyl portion having 14 carbons, and water, and optionally organic solvent.

V. A surfactant composition consisting essentially of: at least about 23%, by weight of the composition, of alkyl ethoxylated sulfate (AES) surfactant, wherein at least 50% of the AES molecules contain an alkyl portion having 14 carbons; from about 1% to about 25%, by weight of the composition, of organic solvent; and water.

W. A single-surfactant detergent composition comprising from about 5% to about 50%, by weight of the composition, of a surfactant system consisting essentially of AES surfactant, wherein from about 46%, or from about 50%, or from about 55%, or from about 58%, to about 82%, or to about 70%, of the AES surfactant molecules contain an alkyl portion having 14 carbons, and a laundry adjunct.

X. Use of an alkyl ethoxylated sulfate (AES) surfactant in a detergent composition to remove soils, preferably greasy soils, wherein at least 50%, or at least 60%, or at least 75%, of the AES molecules contain an alkyl portion having 14 total carbons.

Test Methods

Dynamic Interfacial Tension (DIFT) Analysis

Dynamic Interfacial Tension analysis is performed on a Krüss® DVT30 Drop Volume Tensiometer (Krüss USA, Charlotte, N.C.). The instrument is configured to measure the interfacial tension of an ascending oil drop in aqueous surfactant (surfactant) phase. The oil used is canola oil (Crisco Pure Canola Oil manufactured by The J. M. Smucker Company). The aqueous surfactant and oil phases are temperature controlled at 22° C. (+/−1° C.), via a recirculating water temperature controller attached to the tensiometer. A dynamic interfacial tension curve is generated by dispensing the oil drops into the aqueous surfactant phase from an ascending capillary with an internal diameter of 0.2540 mm, over a range of flow rates and measuring the interfacial tension at each flow rate. Data is generated at oil dispensing flow rates of 500 uL/min to 1 uL/min with 2 flow rates per decade on a logarithmic scale (7 flow rates measured in this instance). Interfacial tension is measured on three oil drops per flow rate and then averaged. Interfacial tension is reported in units of mN/m. Surface age of the oil drops at each flow rate is also recorded and plots may be generated either of interfacial tension (y-axis) versus oil flow rate (x-axis) or interfacial tension (y-axis) versus oil drop surface age (x-axis) Minimum interfacial tension (mN/m) is the lowest interfacial tension at the slowest flow rate, with lower numbers indicating improved performance, for example on greasy soils. Based on instrument reproducibility, differences greater than 0.1 mN/m are significant for interfacial tension values of less than 1 mN/m.

Stain Removal Analysis

Technical stain swatches of white cotton CW120 containing burnt butter, cooked beef, dyed bacon grease and grass are purchased from Accurate Product Development (Cincinnati, Ohio, USA). The stained swatches are washed in conventional North American Traditional Top Loading washing machines (Kenmore 600) in a load containing 2.7 kg ballast and one SBL 2004 artificial soil swatch from WFK (Brueggen, Germany), using 7 grains per gallon hardness (3:1 Ca:Mg), a 64 L fill volume, selecting the Heavy Duty Cycle with a 12 min main wash and wash temperature of 87° F. Approximately 50 g of each of the respective detergent compositions is dosed, such that the ppm delivered through the wash are as reported in the table below. Fabrics are then machine dried (Kenmore 80 series electric tumble dryer) for 45-50 minutes on the Cotton-High Setting.

Image analysis is used to compare each stain to an unstained fabric control. Software converts images taken into standard colorimetric values and compares these to standards based on the commonly used Macbeth Colour Rendition Chart, assigning each stain a colorimetric value (Stain Level). Eight replicates (two internal, four external) of each are prepared.

Stain removal from the swatches is measured as follows:

$$\text{Stain Removal Index } (SRI) = \frac{\Delta E_{initial} - E_{washed}}{\Delta E_{initial}} \times 100$$

$$\Delta E_{initial} = \text{Stain level before washing}$$

$$\Delta E_{washed} = \text{Stain level after washing}$$

Stain removal index scores for each stain are calculated and are listed in the table below.

Percent Transmittance

The Percent Transmittance is measured with a UV-Visible spectrometer such as a Beckman Coulter DUO 800. A standard 10 mm pathlength cuvette is used for the sample measurement and compared to a deionized water blank. Samples are measured in the in the absence of dyes and/or opacifiers, and at a temperature of 20° C.±2° C.

Unless otherwise stated herein, the pH of the composition is defined as the pH of an aqueous 10% (weight/volume) solution of the composition at 20±2° C. Any meter capable of measuring pH to ±0.01 pH units is suitable. Orion meters (Thermo Scientific, Clintinpark-Keppekouter, Ninovesteenweg 198, 9320 Erembodegem-Aalst, Belgium) or equivalent are acceptable instruments. The pH meter should be equipped with a suitable glass electrode with calomel or silver/silver chloride reference. An example includes Mettler DB 115. The electrode should be stored in the manufacturer's recommended electrolyte solution.

The 10% aqueous solution of the detergent is prepared according to the following procedure. A sample of 10±0.05 grams is weighted with a balance capable of accurately measuring to ±0.02 grams. The sample is transferred to a 100 mL volumetric flask, diluted to volume with purified water (deionized and/or distilled water are suitable as long as the conductivity of the water is <5 μS/cm), and thoroughly mixed. About 50 mL of the resulting solution is poured into a beaker, the temperature is adjusted to 20±2° C. and the pH is measured according to the standard procedure of the pH meter manufacturer. The manufacturer's instructions should be followed to set up and calibrate the pH assembly.

Determination of the Average Alkyl Chain Length

The average alkyl chain length of a surfactant, or of a precursor alcohol, is often reported by surfactant suppliers. One of ordinary skill will understand that average alkyl chain length of a sulfated or sulfonated surfactant may be determined and/or reported in terms of the feedstock alcohol.

In the case that only the chain length distribution on a mass basis is reported, the average alkyl chain length can be calculated by the following equation:

$$\text{Average Alkyl Chain length}=(\Sigma CL_i)/(\Sigma(X_i/CL_i))$$

where $X_i$ is the mass fraction of each chain length, $CL_i$.

If the chain length distribution is not available from the surfactant supplier, the chain length distribution can be determined via Gas Chromatography as described in *Analysis of Surfactants*, Second Edition Thomas Schmitt, CRC Press, 2001, pg. 29.

EXAMPLES

The examples provided below are intended to be illustrative in nature and are not intended to be limiting.

The following is a key for the ingredients listed in Examples 1-5.

- C12-14 E3S Anionic surfactant—sulfated and ethoxylated linear alcohol with a chain length distribution of 67% C12/26% C14/6% C16/1% C18 and ethoxylation degree of 3
- C12-14 MS Anionic surfactant—sulfated and ethoxylated linear alcohol with a chain length distribution of 67% C12/26% C14/6% C16/1% C18 and ethoxylation degree of 1
- C14 EIS Anionic surfactant—sulfated and ethoxylated linear alcohol with a chain length distribution of 100% C14 and ethoxylation degree of 1
- C14 E2S Anionic surfactant—sulfated and ethoxylated linear alcohol with a chain length distribution of 100% C14 and ethoxylation degree of 2
- AO Amphoteric Surfactant—$C_{12-14}$ dimethyl Amine Oxide
- NI 12-14 E9 Nonionic surfactant—ethoxylated alcohol having a weight average of 12-14 carbons, and an ethoxylation degree of 9
- LAS Anionic surfactant—linear alkyl benzene sulfonate (alkyl chain has a weight average of 11.8 carbons)

Example 1. Benefits of C14 AES in Combination with Other Surfactants

To demonstrate the benefits of the C14 AES compositions of the present disclosure vs. reference surfactants, Dynamic Oil-water Interfacial Tension (DIFT) analysis is performed.

Samples containing a total surfactant as specified in the table below in water with a hardness (3:1 Ca:Mg) of 7 grains per gallon (gpg) and at pH 8.2-8.5 at 22° C. are prepared with compositions specified in the table below. Each sample is analyzed as described above. Density settings for 22° C. are set at 0.917 g/ml for Canola Oil and 0.998 g/ml for aqueous surfactant phase. The density of the aqueous surfactant phase is assumed to be the same as water since it is a dilute solution. 1.50 mL of 1 (wt/wt) surfactant solution in deionized water is added to a 100 ml volumetric flask to which 3.5 mL of deionized water is added and the volumetric flask is then filled to the mark with a hardness solution of 7.37 gpg water, (3:1 CaCl2:MgCl2 solution) and mixed well. The solution is transferred to a beaker and the pH is adjusted to 8.2-8.5 by adding a few drops of 0.1N NaOH or 0.1N $H_2SO4$. The solution is then loaded into the tensiometer measurement cell and analyzed. The total time from mixing the surfactant solution with the hardness solution to the start of analysis is five minutes.

In Table 1, Samples 1-4 show AES in combination with amine oxide. Samples 5-10 show AES in combination with nonionic surfactant. Samples 11-13 show AES in combination with amine oxide and nonionic surfactant. Samples 14-19 show AES in combination with LAS.

TABLE 1

| Sample | Total Surfactant, ppm | % C14 E1S | % C14 E2S | % C12-14 E1S | % AO | % NI 12-14 E9 | % LAS | Min IFT (mN/m), 1 uL/min |
|---|---|---|---|---|---|---|---|---|
| 1 | 200 | 75 | 0 | 0 | 25 | 0 | 0 | 0.282 |
| 2* | 200 | 0 | 0 | 75 | 25 | 0 | 0 | 0.492 |
| 3 | 200 | 87.5 | 0 | 0 | 12.5 | 0 | 0 | 0.241 |
| 4* | 200 | 0 | 0 | 87.5 | 12.5 | 0 | 0 | 0.424 |
| 5 | 200 | 25 | 0 | 0 | 0 | 75 | 0 | 4.751 |
| 6* | 200 | 0 | 0 | 25 | 0 | 75 | 0 | 5.794 |
| 7 | 200 | 50 | 0 | 0 | 0 | 50 | 0 | 2.890 |
| 8* | 200 | 0 | 0 | 50 | 0 | 50 | 0 | 4.615 |
| 9 | 200 | 75 | 0 | 0 | 0 | 25 | 0 | 1.235 |
| 10* | 200 | 0 | 0 | 75 | 0 | 25 | 0 | 3.060 |
| 11 | 100 | 54 | 0 | 0 | 9 | 37 | 0 | 1.089 |
| 12 | 100 | 0 | 54 | 0 | 9 | 37 | 0 | 1.904 |
| 13* | 100 | 0 | 0 | 54 | 9 | 37 | 0 | 2.656 |
| 14 | 200 | 75 | 0 | 0 | 0 | 0 | 25 | 0.369 |
| 15* | 200 | 0 | 0 | 75 | 0 | 0 | 25 | 0.796 |
| 16 | 200 | 50 | 0 | 0 | 0 | 0 | 50 | 0.344 |
| 17* | 200 | 0 | 0 | 50 | 0 | 0 | 50 | 0.460 |
| 18 | 200 | 25 | 0 | 0 | 0 | 0 | 75 | 0.354 |
| 19* | 200 | 0 | 0 | 25 | 0 | 0 | 75 | 0.451 |

*comparative example

Results show that surfactant formulations containing C14 E1S or C14 E2S AES in combination with AO, NI 12-14 E9, LAS or combinations thereof, across different surfactant ratios, have a lower minimum interfacial tension than surfactant formulations containing C12-14 E1S in combination with the same.

Example 2. Benefits of C14 AES

To demonstrate the benefits of the C14 AES compositions of the present disclosure vs. reference surfactants, Dynamic Oil-water Interfacial Tension (DIFT) analysis is performed.

Samples containing a total at 200 ppm surfactant in water with a hardness (3:1 Ca:Mg) of 3 grains per gallon (gpg) and at pH 8.2-8.5 at 22° C. are prepared with compositions specified in the table below. Each sample is analyzed as described above. Density settings for 22° C. are set at 0.917 g/ml for Canola Oil and 0.998 g/ml for aqueous surfactant phase. The density of the aqueous surfactant phase is assumed to be the same as water since it is a dilute solution. 1.50 mL of 1 (wt/wt) surfactant solution in deionized water is added to a 100 ml volumetric flask to which 3.5 mL of deionized water is added and the volumetric flask is then filled to the mark with a hardness solution of 3.16 gpg water, (3:1 CaCl2:MgCl2 solution) and mixed well. The solution is transferred to a beaker and the pH is adjusted to 8.2-8.5 by adding a few drops of 0.1N NaOH or 0.1N $H_2SO4$. The solution is then loaded into the tensiometer measurement cell and analyzed. The total time from mixing the surfactant solution with the hardness solution to the start of analysis is five minutes.

TABLE 2

| Sample | C12-14 E3S | C14 E1S | % AO | Min IFT (mN/m), 1 uL/min |
|---|---|---|---|---|
| 1 * | 100 | 0 | 0 | 3.535 |
| 2 | 0 | 100 | 0 | 1.377 |
| 3 * | 75 | 0 | 25 | 0.843 |
| 4 | 0 | 75 | 25 | 0.303 |

* comparative example

Results show that both alone and in combination with amine oxide, C14 E1S AES has a lower minimum interfacial tension than C12-14 E3S.

Example 3. Impact of C14 AES Content in Detergent Formulations

Detergent raw materials were mixed to create detergent formulations. The detergent formulations were dosed such the concentration of the surfactant system was 83 ppm AES, 57 ppm NI 12-14 E9, and 14 ppm AO in water with a hardness (3:1 Ca:Mg) of 7 grains per gallon (gpg) and at pH 8.2-8.5 at 22° C. are prepared with compositions specified in the table below. Each sample contains a mixture of C14 E1S and C12-14 E1S such that the percentage C14 content is varied as specified in the table below.

To demonstrate the benefits of the C14 AES compositions of the present disclosure vs. reference surfactants, Dynamic Oil-water Interfacial Tension (DIFT) analysis is performed.

Each sample is analyzed as described above. Density settings for 22° C. are set at 0.917 g/ml for Canola Oil and 0.998 g/ml for aqueous surfactant phase. The density of the aqueous surfactant phase is assumed to be the same as water since it is a dilute solution. 1.50 mL of 1% (wt/wt) surfactant solution in deionized water is added to a 100 ml volumetric flask to which 3.5 mL of deionized water is added and the volumetric flask is then filled to the mark with a hardness solution of 7.37 gpg water, (3:1 CaCl2:MgCl2 solution) and mixed well. The solution is transferred to a beaker and the pH is adjusted to 8.2-8.5 by adding a few drops of 0.1N NaOH or 0.1N $H_2SO4$. The solution is then loaded into the tensiometer measurement cell and analyzed. The total time from mixing the surfactant solution with the hardness solution to the start of analysis is five minutes.

TABLE 3

| Sample | Fraction C14 E1S | Fraction C12-14 E1S | Total % C14 in AES | Min IFT (mN/m), 1 uL/min (sample**) |
|---|---|---|---|---|
| 1 * | 0 | 100 | 26 | 1.967 |
| 2 * | 27 | 73 | 46 | 1.706 |
| 3 * | 44 | 56 | 58 | 1.503 |
| 4 | 60 | 40 | 70 | 1.315 |
| 5 | 76 | 24 | 82 | 1.214 |
| 6 | 92 | 8 | 94 | 1.143 |
| 7 | 100 | 0 | 100 | 1.047 |

* comparative example
**83 ppm total AES, 57 ppm NI 12-14 E9, and 14 ppm AO

Results showed that detergent formulations containing a higher fraction C14 EIS and therefore a higher fraction C14 AES have a lower minimum interfacial tension than surfactant formulations containing a lower fraction C14 AES, such as example 1, which is currently used in the industry and contains 26% C14 AES.

Example 4. Stain Removal

Detergent raw material were mixed to create detergent a formulation. Approximately 50 g of each of the respective detergent compositions is dosed, such that the ppm delivered through the wash are as reported in the table below.

The stain removal of each treatment was assessed by the above Stain Removal method and the Stain Removal Index (SRI) reported. For treatment 1, the absolute SRI is reported while for Treatments 2 and 3, the delta for treatment 1 is reported.

TABLE 4

| Surfactant ppm TTW | | 1* | 2 | 3 |
|---|---|---|---|---|
| Nonionic (NI 12-14 E9) (ppm) | | 57 | 57 | 57 |
| Amine Oxide (ppm) | | 14 | 14 | 14 |
| AES (ppm) | | 83 | 83 | 83 |
| AES Type | | C12-14 E1S | C14 E1S | C14 E2S |
| Stain Removal Results | SRI | Diff | Diff | HSD |
| Dyed Bacon Grease | 53.5 | 3.9 (x) | 1.2 | 2.86 |
| Burnt Butter | 47.0 | 9.3 (x) | 6.1 (x) | 2.52 |
| Cooked Beef | 30.2 | 9.9 (x) | 5.1 (x) | 3.47 |
| Grass | 79.8 | 7.9 (x) | 7.6 (x) | 2.31 |

*comparative composition
(x): significant vs. comparative composition

Results show that the stain removal is significantly higher for C14 E1S on dyed bacon grease, burnt butter, cooked beef and grass vs. C12-14 E1S. Results show that the stain removal is significantly higher for C14 E1S on burnt butter, cooked beef and grass vs. C12-14 E1S.

Example 5. Impact of AES C14 Content in an AES-Rich Single-Surfactant System

To demonstrate the benefits of the C14 AES compositions of the present disclosure vs. reference surfactants, Dynamic Oil-water Interfacial Tension (DIFT) analysis is performed.

Surfactant formulations containing 200 ppm AES in water with a hardness (3:1 Ca:Mg) of 7 grains per gallon (gpg) and at pH 8.2-8.5 at 22° C. are prepared with compositions specified in the table below. Each sample contains a mixture of C14 E1S and/or C12-14 E1S such that the amount of C14 content is varied as specified in the table below.

Each sample is analyzed as described above. Density settings for 22° C. are set at 0.917 g/ml for Canola Oil and 0.998 g/ml for aqueous surfactant phase. The density of the aqueous surfactant phase is assumed to be the same as water since it is a dilute solution. 1.50 mL of 1% (wt/wt) surfactant solution in deionized water is added to a 100 ml volumetric flask to which 3.5 mL of deionized water is added and the volumetric flask is then filled to the mark with a hardness solution of 7.37 gpg water, (3:1 CaCl2:MgCl2 solution) and mixed well. The solution is transferred to a beaker and the pH is adjusted to 8.2-8.5 by adding a few drops of 0.1N NaOH or 0.1N $H_2SO4$. The solution is then loaded into the tensiometer measurement cell and analyzed. The total time from mixing the surfactant solution with the hardness solution to the start of analysis is five minutes.

TABLE 5

| Sample | Fraction C14 E1S | Fraction C12-14 E1S | % C14 in AES | Min IFT (mN/m), 1 uL/min |
|---|---|---|---|---|
| 1 | 0 | 100 | 26 | 1.280 |
| 2 | 27 | 73 | 46 | 0.794 |
| 3 | 44 | 56 | 58 | 0.507 |
| 4 | 60 | 40 | 70 | 0.529 |
| 5 | 76 | 24 | 82 | 0.865 |
| 6 | 92 | 8 | 94 | 0.932 |
| 7 | 100 | 0 | 100 | 0.983 |

Results show that as a single surfactant, the lowest interfacial tension is achieved between 46 and 82% C14 AES.

Example 6. Heavy Duty Liquid Laundry Detergent Compositions

Heavy duty liquid laundry detergent compositions are made by mixing together the ingredients listed in the proportions shown in Table 6.

TABLE 6

| Raw Material | A | B | C | D | E | F | G | H | 1 | J | K | L |
|---|---|---|---|---|---|---|---|---|---|---|---|---|
| AES | 11.2 | 14.6 | 7.7 | 7.4 | 20.3 | 12.0 | 1.4 | 7.4 | 8.6 | 14.6 | 4.8 | 7.0 |
| LAS | 0.0 | 2.2 | 0.0 | 7.9 | 0.0 | 4.8 | 10.1 | 4.7 | 3.7 | 8.8 | 10.5 | 7.0 |
| AE | 4.9 | 6.7 | 1.9 | 4.8 | 16.6 | 4.7 | 6.1 | 0.0 | 0.7 | 3.7 | 4.8 | 7.0 |
| $C_{12-14}$ dimethyl Amine Oxide | 2.7 | 2.0 | 0.6 | 1.0 | 3.2 | 0.0 | 0.5 | 0.0 | 0.5 | 0.9 | 0.0 | 0.0 |
| Lauryl Trimethyl Ammonium Chloride | 0 | 0 | 0 | 0.25 | 0 | 0.5 | 0 | 1 | 0 | 0 | 0 | 0 |
| Sodium formate | 2 | 0.09 | 1.2 | 0 | 1.6 | 0 | 0.2 | 1.6 | 0.09 | 1.2 | 0 | 1.6 |
| Calcium formate | 0 | 0 | 0 | 0.04 | 0 | 0.2 | 0 | 0.1 | 0 | 0 | 0.04 | 0 |
| Calcium Chloride | 0.01 | 0.08 | 0 | 0 | 0 | 0 | 0.001 | 0.01 | 0.08 | 0 | 0 | 0 |
| Monoethanolamine | 1.4 | 1 | 4 | 0.5 | 0 | To pH 8.2 | 2 | 1.4 | 1 | 2.6 | 0.5 | 0.5 |
| Diethylene glycol | 5.5 | 0 | 4.1 | 0 | 0.7 | 0 | 0 | 3 | 0 | 2 | 0 | 0 |
| Chelant | 0.15 | 0.15 | 0.11 | 0 | 0.5 | 0.11 | 0.8 | 0.15 | 0.15 | 0.11 | 0.07 | 0.15 |
| Citric Acid | 2.5 | 3.96 | 1.88 | 1.98 | 0.9 | 2.5 | 0.6 | 2.5 | 4 | 0 | 1.98 | 1.7 |
| Fatty Acid | 0.8 | 3.5 | 0.6 | 0.99 | 1.2 | 0 | 15 | 0.76 | 2.6 | 2.6 | 0.7 | 0.7 |
| Borax | 1.43 | 2.1 | 2 | 0.75 | 0 | 1.07 | 0 | 1.43 | 2.1 | 1.1 | 0.75 | 2.1 |
| Ethanol | 1.54 | 2 | 1.15 | 0.89 | 0 | 3 | 7 | 1.54 | 2 | 1.15 | 0.89 | 2 |
| Ethoxylated Polyethylenimine | 0 | 1.4 | 0 | 3 | 0 | 0 | 0.8 | 0 | 2 | 0 | 0 | 1 |
| Zwitterionic ethoxylated quaternized sulfated hexamethylene diamine | 2.1 | 0 | 0.7 | 1.6 | 0.3 | 1.6 | 0 | 0.6 | 0.6 | 0 | 0.6 | 0 |
| PEG-PVAc Polymer | 0.1 | 0.2 | 0 | 4 | 0.05 | 0 | 1 | 1.1 | 1.1 | 1.1 | 2.2 | 0 |
| Grease Cleaning Alkoxylated Polyalkylenimine Polymer | 1 | 2 | 0 | 0 | 1.5 | 0 | 0 | 0 | 4 | 0 | 0 | 1 |
| Soil Release Agent | 0 | 0 | 1 | 2 | 0 | 1.5 | 0 | 0 | 0.5 | 0 | 0 | 1 |
| 1,2-Propanediol | 12 | 2.6 | 0 | 3.3 | 0.5 | 2 | 8 | 0 | 6.6 | 0 | 3.3 | 4 |
| Sodium Cumene sulphonate | 0 | 0 | 0.5 | 1 | 5 | 0 | 0 | 2 | 0 | 0.5 | 1 | 0 |
| Fluorescent Brightener | 0.2 | 0.1 | 0.05 | 0.3 | 0.15 | 0.3 | 0.2 | 0.2 | 0.1 | 0 | 0.3 | 0.02 |
| Hydrogenated castor oil derivative structurant | 0.1 | 0 | 0.4 | 0 | 0 | 0 | 0.1 | 0.1 | 0 | 0.4 | 0 | 0 |
| Perfume | 1.6 | 1.1 | 1 | 0.1 | 0.9 | 1.5 | 1.6 | 1.6 | 1.1 | 1 | 0.1 | 0.1 |
| Core Shell Melamine-formaldehyde encapsulate of perfume | 0.5 | 0.05 | 0 | 0.02 | 0.1 | 0.05 | 0.1 | 0.5 | 0.05 | 0 | 0.02 | 0 |
| Protease (40.6 mg active/g) | 0.8 | 0.6 | 0 | 0.9 | 0.7 | 0.2 | 1.5 | 0.01 | 0.6 | 0.7 | 0.9 | 0.9 |
| Mannanase: (25 mg active/g) | 0.07 | 0.05 | 0 | 0.06 | 0.04 | 0.001 | 0.1 | 0.07 | 0.05 | 0 | 0.06 | 0.07 |
| Amylase: (15 mg active/g) | 0.3 | 0 | 0.3 | 0.1 | 0 | 0.6 | 0.01 | 0.3 | 0 | 0.3 | 0.1 | 0.3 |
| Xyloglucanase (20 mg active/g) | 0.2 | 0.1 | 0 | 0 | 0.05 | 0.01 | 0.2 | 0.2 | 0.1 | 0 | 0 | 0 |
| Lipase: (18 mg active/g) | 0.4 | 0.2 | 0.3 | 0.1 | 0.2 | 0 | 0 | 0.4 | 0.001 | 0.3 | 0.1 | 0 |
| Suds Suppressor | 0 | 0 | 0.21 | 0 | 0 | 0 | 0 | 0.21 | 0 | 0.21 | 0 | 0.1 |
| Hueing Agent | 0 | 0 | 0 | 0 | 0.05 | 0 | 0 | 1 | 0 | 0 | 0 | 0.001 |
| *Water, dyes & minors | | | | | | Balance | | | | | | |

Example 7. Compact/Unit Dose Compositions

Compact or unit dose laundry detergent formulations are made by mixing together the ingredients listed in the proportions shown in Table 7. The formulations may be encapsulated in a water-soluble film, such as M8630 (ex MonoSol LLC) to form a unit dose article. Such unit dose articles can comprise one or multiple compartments.

TABLE 7

| Raw Material | M | N | O | P | Q | R |
|---|---|---|---|---|---|---|
| AES | 18.0 | 25.0 | 13.0 | 7.5 | 22.0 | 14.0 |
| AE | 19.0 | 2.0 | 14.0 | 6.0 | 1.0 | 2.0 |
| LAS | 0.0 | 12.0 | 14.0 | 14.5 | 17.0 | 24.0 |
| $C_{12-14}$ dimethyl Amine Oxide | 4.0 | 2.0 | 0.0 | 0.0 | 0.0 | 0.0 |
| Citric Acid | 2.0 | 0.6 | 1.6 | 1.6 | 0.6 | 0.6 |
| Fatty Acid | 4.0 | 10.0 | 4.5 | 16.0 | 4.5 | 4.5 |
| Enzymes | 1.0 | 0.5 | 0.8 | 0.01 | 2.0 | 1.5 |
| Ethoxylated Polyethyleneimine | 1.4 | 1.4 | 4.0 | 7.0 | 4.0 | 4.0 |
| Chelant | 0.6 | 0.3 | 2.0 | 1.2 | 3.0 | 3.0 |
| PEG-PVAc Polymer | 4.0 | 2.5 | 1.0 | 2.5 | 1.5 | 1.5 |
| Fluorescent Brightener | 0.2 | 0.4 | 0.3 | 0.3 | 0.1 | 0.3 |
| 1,2 propanediol | 10.0 | 15.0 | 18.0 | 14.8 | 13.0 | 13.8 |
| Glycerol | 13.0 | 4.0 | 6.1 | 6.1 | 6.1 | 6.1 |
| Monoethanolamine | 9.8 | 10.0 | 6.7 | 8.0 | 9.8 | 9.8 |
| TIPA | — | — | 2.0 | — | — | — |
| Triethanolamine | — | 2.0 | — | — | — | — |
| Sodium Cumene sulphonate | — | — | — | — | 2.0 | 2.0 |
| Cyclohexyl dimethanol | — | — | — | 2.0 | — | — |
| Water | 12.0 | 10.0 | 9.0 | 10.0 | 10.0 | 10.0 |
| Structurant | 0.1 | 0.14 | 0.14 | 0 | 0.2 | 0.14 |
| Perfume | 0.2 | 1.9 | 1 | 1.9 | 1.9 | 1.9 |
| Hueing Agent | 0 | 0.1 | 0.001 | 0.0001 | 0 | 0 |
| Buffers (monoethanolamine) | To pH 8.0 | | | | | |
| Solvents (1,2 propanediol, ethanol) | To 100% | | | | | |

All enzyme levels are expressed as % enzyme raw material.

Raw Materials for Examples

AES is alkyl ethoxylated sulfate, where at least 50% AES molecules have $C_{14}$ alkyl chains, where the degree of ethoxylation is from about 0.5 to about 3.

LAS is linear alkylbenzenesulfonate having an average aliphatic carbon chain length $C_{11}$-$C_{12}$ supplied by Stepan, Northfield, Ill., USA or Huntsman Corp. HLAS is acid form.

AE is selected from $C_{12-13}$ with an average degree of ethoxylation of 6.5, $C_{12-14}$ with an average degree of ethoxylation of 7, $C_{14-15}$ with an average degree of ethoxylation of 7, or $C_{12-14}$ with an average degree of ethoxylation of 9, all supplied by Huntsman, Salt Lake City, Utah, USA or Shell Chemicals, Houston, Tex., USA.

$C_{12-14}$ dimethyl Amine Oxide is supplied by Procter & Gamble Chemicals, Cincinnati, USA.

PEG-PVAc polymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).

Ethoxylated Polyethylenimine is a 600 g/mol molecular weight polyethylenimine core with 20 ethoxylate groups per—NH. Available from BASF (Ludwigshafen, Germany).

Zwitterionic ethoxylated quaternized sulfated hexamethylene diamine is described in WO 01/05874 and available from BASF (Ludwigshafen, Germany).

Grease Cleaning Alkoxylated Polyalkyleneimine Polymer is a 600 g/mol molecular weight polyethylenimine core with 24 ethoxylate groups per—NH and 16 propoxylate groups per—NH. Available from BASF (Ludwigshafen, Germany).

Lipases (Lipex®), Cellulases (Celluclean™), Mannanases (Mannaway®) and Xyloglycanases (Whitezyme®) may be supplied by Novozymes, Bagsvaerd, Denmark.

Proteases may be supplied by Genencor International, Palo Alto, Calif., USA (e.g. Purafect Prime®) or by Novozymes, Bagsvaerd, Denmark (e.g. Liquanase®, Coronase®).

Suitable Fluorescent Brighteners are for example, Tinopal® TAS, Tinopal® AMS, Tinopal® CBS-X, Sulphonated zinc phthalocyanine, available from BASF, Ludwigshafen, Germany.

Chelant is selected from, diethylenetetraamine pentaacetic acid (DTPA) supplied by Dow Chemical, Midland, Mich., USA, hydroxyethane di phosphonate (HEDP) supplied by Solutia, St Louis, Mo., USA; Ethylenediamine-N,N'-disuccinic acid, (S,S) isomer (EDDS) supplied by Octel, Ellesmere Port, UK, Diethylenetriamine penta methylene phosphonic acid (DTPMP) supplied by Thermphos, or 1,2-dihydroxybenzene-3,5-disulfonic acid supplied by Future Fuels Batesville, Ark., USA Hueing agent is Direct Violet 9 or Direct Violet 99, supplied by BASF, Ludwigshafen, Germany. Soil release agent is Repel-o-tex® PF, supplied by Rhodia, Paris, France.

Suds suppressor and suds suppressor agglomerate are supplied by Dow Corning, Midland, Mich., USA 1,2 propanediol be supplied by Archer Daniels Midland, Chicago, Ill., USA or Dow Chemical Midland, Mich., USA Monoethanolamine (MEA), Triethanolamine (ILA), Triisopropanolamine (TIPA) and Cyclohexyl dimethanol can be supplied by Dow Chemical Midland, Mich., USA Diethylene glycol can be supplied by ME-Global (Dubai, United Arab Emirates)

Glycerol is supplied by Procter & Gamble Chemicals, Cincinnati, USA.

Sodium Cumene Sulfonate can be supplied by Stepan, Northfield, Ill., USA $C_{12-18}$ Fatty Acid can be supplied by Wilmar, Singapore.

Citric Acid and Ethanol can be supplied by Tate and Lyle, London, England.

Borax can be supplied by US Borax Valencia, Calif., USA.

Lauryl Trimethyl Ammonium Chloride can be supplied by Evonik, Essen, Germany.

Sodium Formate and Calcium Formate can be supplied by Perstorp, Toledo, Ohio, USA.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising:

from about 5% to about 50%, by weight of the composition, of a surfactant system, the surfactant system comprising an 75-85% of alkyl ethoxylated sulfate (AES) surfactant, 50-60% of an ethoxylated alcohol nonionic surfactant, and 10-20% of amine oxide, wherein at least 50%, by mass, of the AES molecules contain an alkyl portion having 14 carbons, wherein at least 50% of the AES molecules have alkyl portions that are linear alkyl portions, wherein the AES is characterized by an average degree of ethoxylation of from about 0.5 to about 3.0, wherein the ethoxylated alcohol nonionic surfactant has an average of about C12-C14 carbon atoms in the alcohol and an average degree of ethoxylation of about 7-9 moles of ethylene oxide per mole of alcohol, wherein the amine oxide is a C10-C18 alkyl dimethyl amine oxide, and wherein the AES and the amine oxide are present in a weight ratio of from about 4:1 to about 8:1, a laundry adjunct, wherein the detergent composition has a pH of from 8.0 to about 8.5, measured as the pH of an aqueous 10% (weight/volume) solution of the composition at 20±2° C.

2. A detergent composition according to claim 1, wherein at least 60%, or at least 65%, or at least 70%, or at least 80%, or at least 90%, or at least 95% of the AES molecules contain an alkyl portion having 14 carbons.

3. A detergent composition according to claim 1, wherein at least at least 60% of the AES molecules have alkyl portions having an even total number of carbon atoms.

4. A detergent composition according to claim 1, wherein the surfactant system further comprises additional surfactant selected from the group consisting of alkyl benzene sulphonate, methyl ester sulphonate, glycolipid surfactant, alkylpolyglucoside surfactant, or combinations thereof.

5. A detergent composition according to claim 1, wherein the surfactant system comprises less than 25%, of linear alkyl benzene sulfonate, and wherein the AES is characterized by an average degree of ethoxylation of from about 0.5 to about 2.0.

6. A detergent composition according to claim 1, wherein the detergent composition is free of silicone, dye, brightener, or combinations thereof.

7. A detergent composition according to claim 1, wherein the detergent composition comprises less than 5%, by weight of the composition, of amine-containing compounds, with the proviso that amine oxide surfactant is not included in the total amount of amine-containing compounds.

8. A detergent composition according to claim 1, wherein the composition has a percent transmittance at 570 nm of greater than about 50%.

9. A detergent composition according to claim 1, wherein the laundry adjunct is selected from the group consisting of a structurant, a builder, a fabric softening agent, a polymer or an oligomer, an enzyme, an enzyme stabilizer, a bleach system, a brightener, a hueing agent, a chelating agent, a suds suppressor, a conditioning agent, a humectant, a perfume, a encapsulated perfume, a filler or carrier, an alkalinity system, a pH control system, a buffer, an alkanolamine, a solvent, and mixtures thereof.

10. A detergent composition according to claim 1, wherein the laundry adjunct comprises an encapsulated perfume.

11. A method of treating a fabric, the method comprising the steps of: providing a fabric, wherein the fabric optionally contains a greasy soil, contacting the fabric with a composition according to claim 1, and agitating the fabric in the presence of water.

* * * * *